US006637036B2

(12) United States Patent
Béland

(10) Patent No.: US 6,637,036 B2
(45) Date of Patent: Oct. 28, 2003

(54) PROTECTIVE PANTS

(75) Inventor: Jean François Béland, St-Laurent (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/986,286

(22) Filed: Nov. 8, 2001

(65) Prior Publication Data

US 2002/0042944 A1 Apr. 18, 2002

(51) Int. Cl.[7] ..... A41D 13/00
(52) U.S. Cl. ..... 2/227; 2/467
(58) Field of Search ..... 2/455, 22, 466, 2/467, 69, 79, 227, 456, 464, 44, 92, 235, 236, 238, 239, 61, 237, 240; 128/96.1, 100.1, 101.1, 102.1; 602/5, 19

(56) References Cited

U.S. PATENT DOCUMENTS

| | | | | | |
|---|---|---|---|---|---|
| 417,450 | A | | 12/1889 | Van Duzer | |
| 759,765 | A | | 5/1904 | Stall | |
| 759,833 | A | | 5/1904 | Stall | |
| 841,514 | A | | 1/1907 | Halligan | |
| 851,930 | A | | 4/1907 | Greenberger | |
| 1,641,733 | A | | 6/1927 | Bullock | |
| 1,757,640 | A | * | 5/1930 | Levinson | 2/22 |
| 1,857,850 | A | | 5/1932 | Jones | |
| 1,915,754 | A | | 6/1933 | O'Shea | |
| 2,629,094 | A | | 2/1953 | Goldsmith | |
| 3,170,163 | A | | 2/1965 | Mitchell | |
| 3,484,868 | A | | 12/1969 | Davenport, Jr. | |
| 3,787,892 | A | | 1/1974 | Quinn | |
| 4,325,148 | A | | 4/1982 | Livernois | |
| 4,577,346 | A | | 3/1986 | Hall | |
| 4,807,301 | A | * | 2/1989 | Ferber | 2/465 |
| 5,365,610 | A | | 11/1994 | Lubahn et al. | |
| 5,632,723 | A | * | 5/1997 | Grim | 602/19 |
| 5,833,638 | A | * | 11/1998 | Nelson | 602/19 |
| 5,926,856 | A | | 7/1999 | Duval | |
| 5,966,739 | A | | 10/1999 | Wagner | |

* cited by examiner

*Primary Examiner*—Tejash Patel

(57) ABSTRACT

The invention provides hockey pants comprising a main body, a fixed belt, and a floating belt. More specifically, the main body includes a pelvic area portion, a right thigh area portion, and a left thigh area portion. The fixed belt, which is integrally connected to the main body, comprises a plurality of padding elements that are selectively positioned and that act to protect the user's midsection. The selectively positioned padding elements include an adjustable dorsal protector adapted to extend over and protect the lower spine region of the wearer. Moreover, the fixed belt also includes an adjusting component capable of modifying the positioning of the dorsal protector relative to the back of the wearer's body. Overlying the fixed belt is the floating belt which, due to its flexible coupling with the main body, allows access to the adjusting component.

29 Claims, 8 Drawing Sheets

PROTECTIVE PANTS

FIELD OF THE INVENTION

The present invention relates to protective equipment for hockey and other such sporting activities. More specifically, the invention relates to an adjustable hockey pant that features enhanced dorsal protection and which is generally used by forwards and defensemen.

BACKGROUND OF THE INVENTION

In recent years, security has become an issue of ever-increasing importance in professional and amateur sports alike. Sports such as hockey, for example, are rapidly evolving and becoming more physically demanding since players tend to be faster and stronger than before. Consequently, protective equipment such as hockey pants must also evolve to better suit the needs of today's players.

Conventional wisdom has to date dictated that hockey pants typically protect an individual's midsection. More specifically, traditional hockey pants protect the area of the human body that is delimited, at an upper end, by the waist and, at a lower end, by the knees. Protection is therefore provided to the upper leg and pelvic regions of the wearer.

A deficiency typically associated with the above-mentioned protective equipment is the fact that the lower back area of the player is inadequately protected since the pants do not extend beyond the waist. Moreover, no provisions are made to increase the level of protection in this particular region. Thus, a very sensitive region of the human body, namely the lower region of the spinal cord, is exposed to injury. This problematic situation is compounded by the fact that the player, during the course of a game or practice, often adopts numerous positions or stances resulting in an area of the lower back being repeatedly left exposed, in varying degrees, and therefore subject to injury.

A protective pant offering enhanced protection to the midsection region of the wearer is disclosed in U.S. Pat. No. 5,926,856 (Duval). It comprises a back padded region characterized by vertical panels that are separated from one another by vertical seams. Due to its construction, the vertical panels can pivot about their respective seams and thereby attempt to follow the contours of the wearer's body when the latter is in motion.

A deficiency associated with the above-noted Duval protective pant is that although it does attempt to better follow the contours of the wearer's body, it makes no provisions for situations in which a player leans forward or back. Such situations occur very frequently during the course of a game or practice. In fact, the classic stance or profile of a hockey player when the latter is skating forwards is one in which the body is bent forwards at varying degrees.

Another deficiency related to the Duval protective pant is that it is not suited to accommodate different player anatomies as well as specific individual preferences. Some players, for example, have body types with centers of gravity that are slightly more inclined towards the front and therefore would prefer a hockey pant including a dorsal support that conforms itself to their body type. Other players, however, prefer the freedom associated with a hockey pant that makes no attempt to conform to the body.

There is therefore a need in the sports industry for hockey pants that can offer enhanced levels of protection as required by contemporary athletes, and that can better ergonomically fit the wearer as well as suit his or her preferences.

SUMMARY OF THE INVENTION

It is an object of the present invention to provide protective equipment having an enhanced level of protection which overcomes some of the disadvantages of the prior art.

In accordance with a broad aspect, the invention provides hockey pants comprising a main body, a fixed belt, and a floating belt. More specifically, the main body includes a pelvic area portion, a right thigh area portion, and a left thigh area portion. The fixed belt, which is integrally connected to the main body, comprises a plurality of padding elements that are selectively positioned and that act to protect the user's midsection. The selectively positioned padding elements include an adjustable dorsal protector adapted to extend over and protect the lower spine region of the wearer. Moreover, the fixed belt also includes an adjusting component capable of modifying the positioning of the dorsal protector relative to the back of the wearer's body. Overlying the fixed belt is the floating belt which, due to its flexible coupling with the main body, allows access to the adjusting component.

In a specific example of implementation of the invention, the adjusting component comprises a set of adjustment straps and buckles. The adjustment straps each extend from one side of the dorsal protector to an adjacent portion of the fixed belt. The dorsal protector, in this example of implementation, is of trapezoidal shape and comprises seams that extend in a substantially vertical direction and which increase its flexibility.

The fixed belt also features a waist-adjustment component, in the form of a belt and fastening buckle, that permits the user to modify the fit of the hockey pants to accommodate his or her girth. A gluteus padding element is also attached to the fixed belt and protects the hind portion of the wearer.

Continuing with this example of implementation, the main body further comprises a plurality of selectively positioned portions made of fabric exhibiting elastic properties. These selectively positioned portions allow for greater mobility of the hockey pants while the latter are in use.

In accordance with a second broad aspect, the invention provides hockey pants comprising a main body and a fixed belt. More specifically, the main body includes a pelvic area portion, a right thigh area portion, and a left thigh area portion. The fixed belt comprises a plurality of padding elements that are selectively positioned and act to protect the user's midsection. The selectively positioned padding elements include an adjustable dorsal protector adapted to extend over and protect the lower spine region of the wearer. Moreover, the fixed belt also includes an adjusting component capable of modifying the positioning of the dorsal protector relative to the back of the wearer's body.

In a specific example of implementation of the invention, the adjusting component comprises a set of adjustment straps and buckles. The adjustment straps each extend from one side of the dorsal protector to an adjacent portion of the fixed belt. The dorsal protector, in this example of implementation, is of trapezoidal shape and comprises seams that extend in a substantially vertical direction and which increase its flexibility.

The fixed belt, which underlies a floating belt flexibly connected to the main body, also features a waist-adjustment component, in the form of a belt and fastening buckle, that permits the user to modify the fit of the hockey pants to accommodate his or her girth. A gluteus padding element is attached to the fixed belt and protects the hind portion of the wearer.

In this example of implementation, the main body further comprises a plurality of selectively positioned portions made of fabric exhibiting elastic properties. These selectively positioned portions allow for greater mobility of the hockey pants while the latter are in use.

In accordance with a third broad aspect, the invention provides protective equipment comprising a main body and a belt. More specifically, the main body includes a pelvic area portion, a right thigh area portion, and a left thigh area portion. The belt comprises a plurality of padding elements that act to protect the wearer's midsection. The plurality of padding elements include an adjustable dorsal protector adapted to extend over and protect the lower spine region of the wearer. Moreover, the belt also includes means that permit the adjustment of the positioning of the dorsal protector relative to the back of the wearer's body.

In a specific example of implementation of the invention, the means comprise a set of adjustment straps and buckles. The adjustment straps each extend from one side of the dorsal protector to an adjacent portion of the belt.

In yet another broad aspect, the invention provides in association with pelvic protection, for the game of hockey, an adjustable dorsal protector and adjusting means for varying the positioning of the dorsal protector.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

A detailed description of the preferred embodiments of the present invention is provided herein below, by way of example only, with reference to the accompanying drawings, in which.

Figure 1:
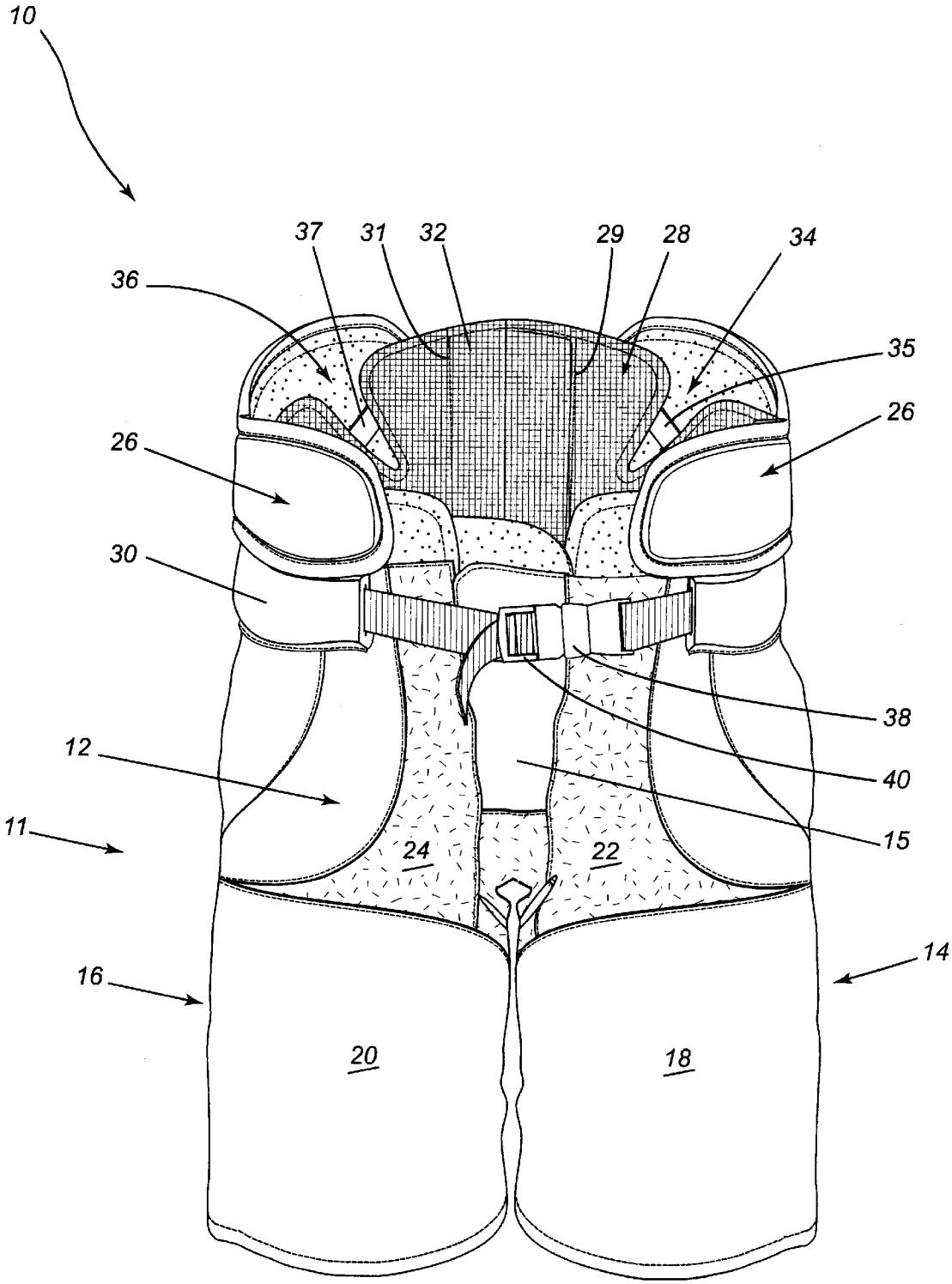
FIG. 1 is a front elevational view of hockey pants constructed in accordance with an embodiment of the invention, the hockey pants being shown with all of its components.

In the drawings, preferred embodiments of the invention are illustrated by way of examples. It is to be expressly understood that the description and the drawings are only for purposes of illustration and as an aid to understanding. They are not intended to be a definition of the limits of the invention.

DETAILED DESCRIPTION OF PREFERRED EMBODIMENTS

Figure 2:
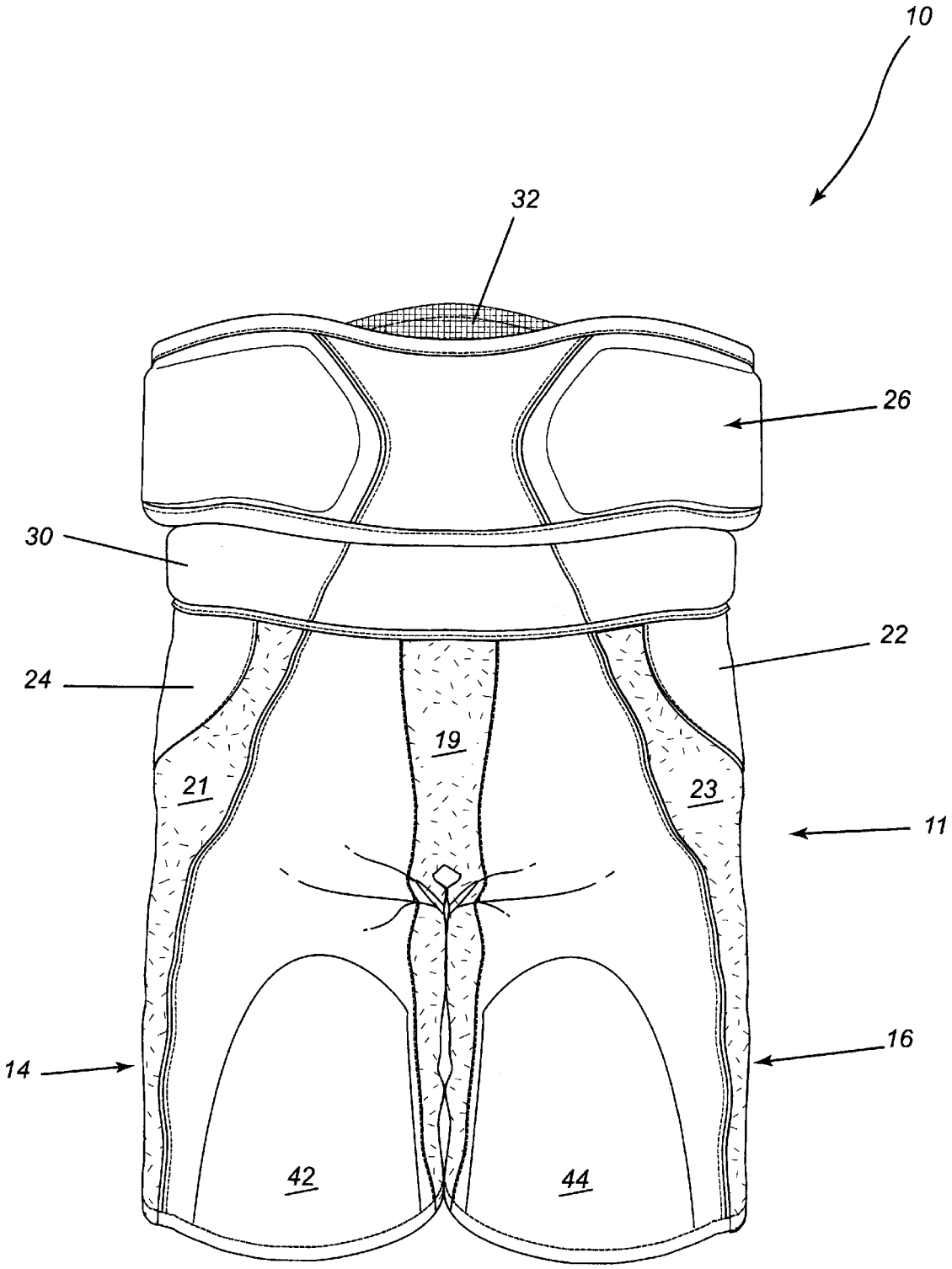
FIG. 2 is a rear elevational view of the hockey pants depicted in FIG. 1.
Figure 3:
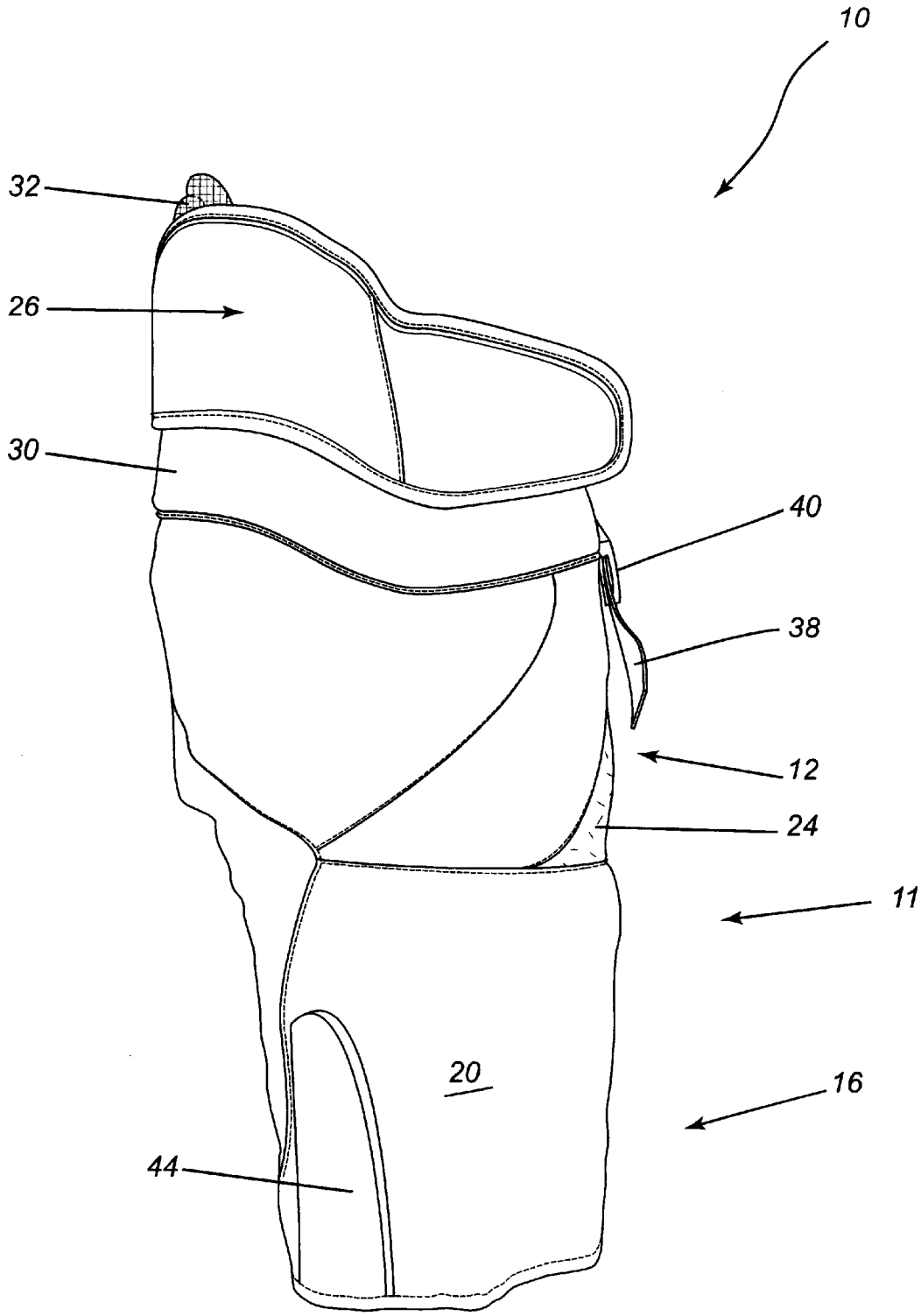
FIG. 3 is a right side elevational view of the hockey pants depicted in FIG. 1.

With reference to FIGS. 1 to 3, there is shown a non-limiting example of implementation of the present inventive concept. FIGS. 1 to 3 illustrate hockey pants, designated by reference numeral 10, that comprise a main body 11, a floating belt 26, and a fixed belt 28. As shown, main body 11, the majority of which is fabricated from a single or multi layered nylon material that is resistant to wear and tear as well as water repellant, further includes a pelvic area portion 12 as well as left and right thigh area portions 14, 16. The pelvic area portion 12 encloses the pelvis of the wearer while the left and right thigh area portions 14, 16 respectively enclose the left and right upper legs of the wearer. The figures further show that several zones 19, 21, 22, 23, 24 in the frontal and dorsal regions of main body 11 are made from a material exhibiting some elastic properties which allows greater mobility to the user of the hockey pants 10. A plurality of selectively positioned padding elements are also integrally attached to hockey pants 10. More specifically, left and right thigh area portions 14, 16 each respectively include rigid front thigh padding elements 18, 20. Rigid front thigh padding elements 18, 20, which are generally characterized by a certain curvature in order to better follow the contour of the wearer's legs, are enclosed and thereby dissimulated within special pockets sewn in for this specific purpose. As shown in FIG. 2, the rear area of each thigh area portion 14, 16, at its lower extremity, respectively includes a rear thigh padding element 42 and 44. Rear thigh padding elements 42 and 44 are generally supple in nature and do not extend very high up the legs of the wearer so as to not significantly hinder the mobility of the player.

As shown in FIG. 1, a fixed belt 28 is integrally connected to the upper portion of the hockey pants 10. Fixed belt 28 will be described in greater detail herein after with reference to subsequent figures since a floating belt 26 overlies fixed belt 28 and thereby partially conceals it. Although not shown, floating belt 26 is integrally connected to main body 11 by elastic straps that are spaced about the upper periphery of hockey pants 10 thereby giving it a floating quality as it is not rigidly attached to main body 11. Floating belt 26, due to its shape and the fact that it includes a series of dissimulated integral padding elements, surrounds the user's midsection region and provides protection to the latter. More specifically, as shown in FIG. 2, floating belt 26 slightly extends past the user's waist region thereby protecting the lower kidney area. From a side perspective, as shown in FIG. 3, floating belt 26 is tapered towards the front. Thus, floating belt 26 provides protection to the side regions of the wearer while not significantly impeding the latter's mobility.

Figure 4:
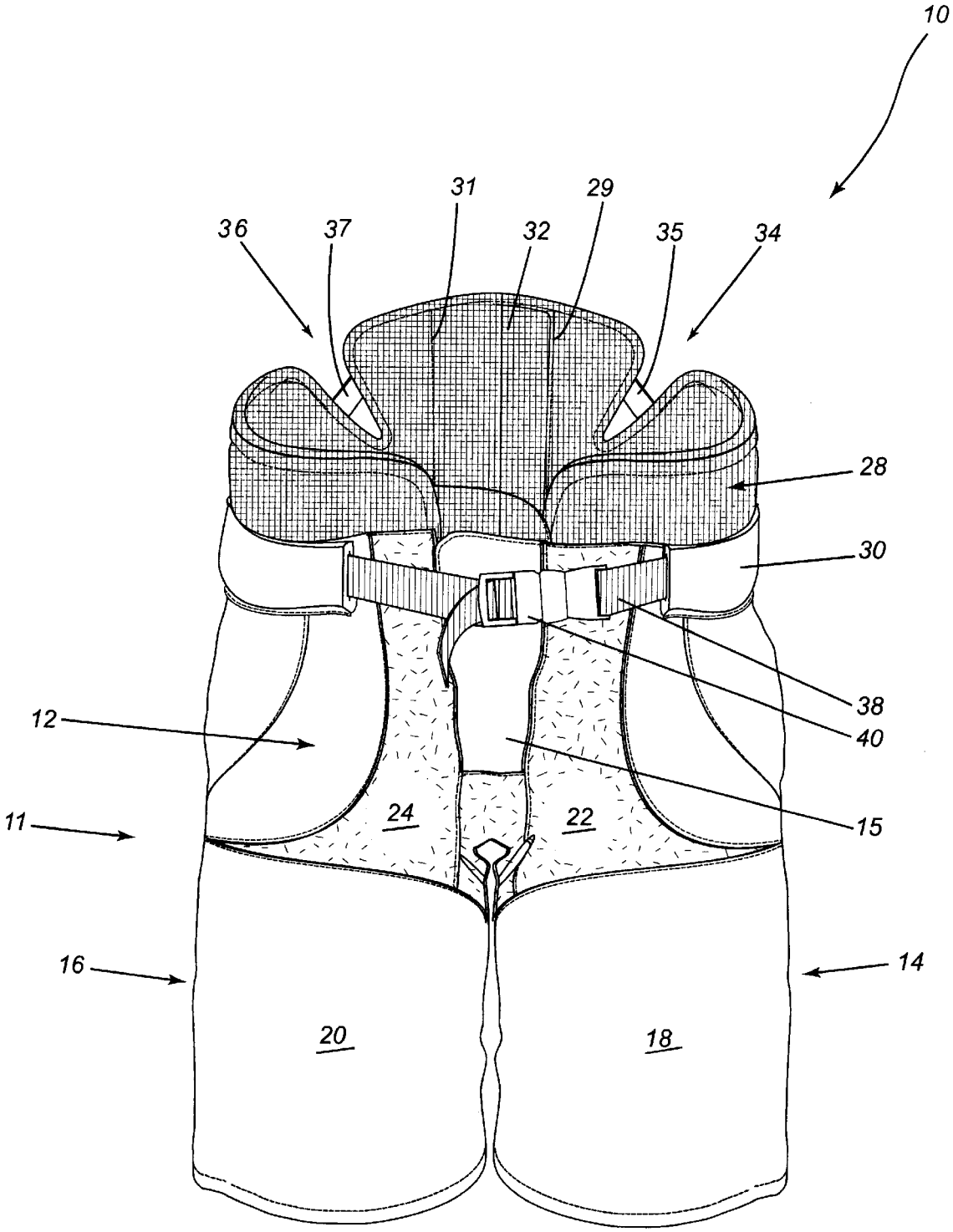
FIG. 4 is a front elevational view of the hockey pants depicted in FIG. 1, the floating belt being removed to more clearly show the fixed belt and its dorsal protector.
Figure 5:
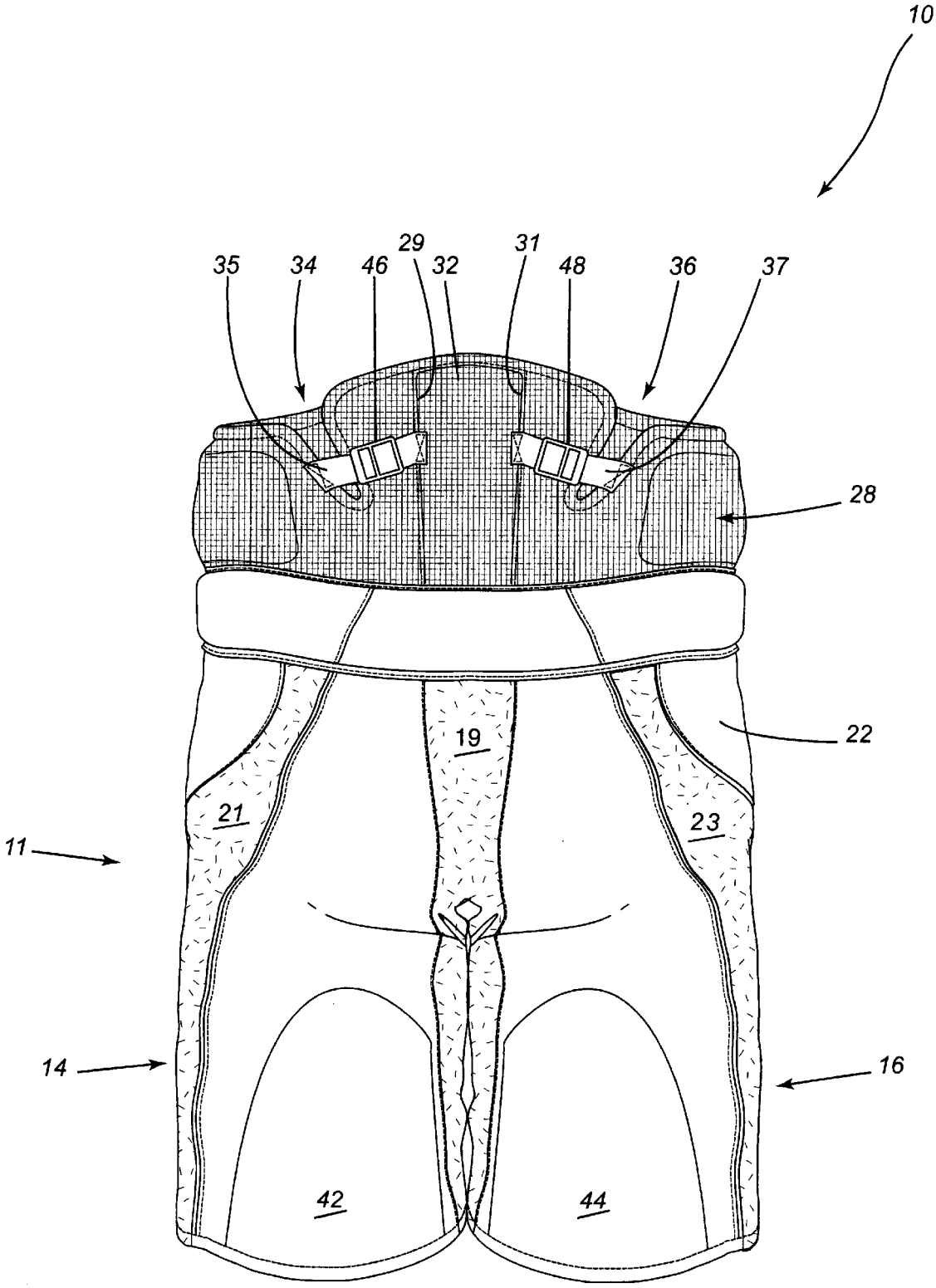
FIG. 5 is a rear elevational view of the hockey pants as depicted in FIG. 4.
Figure 6:
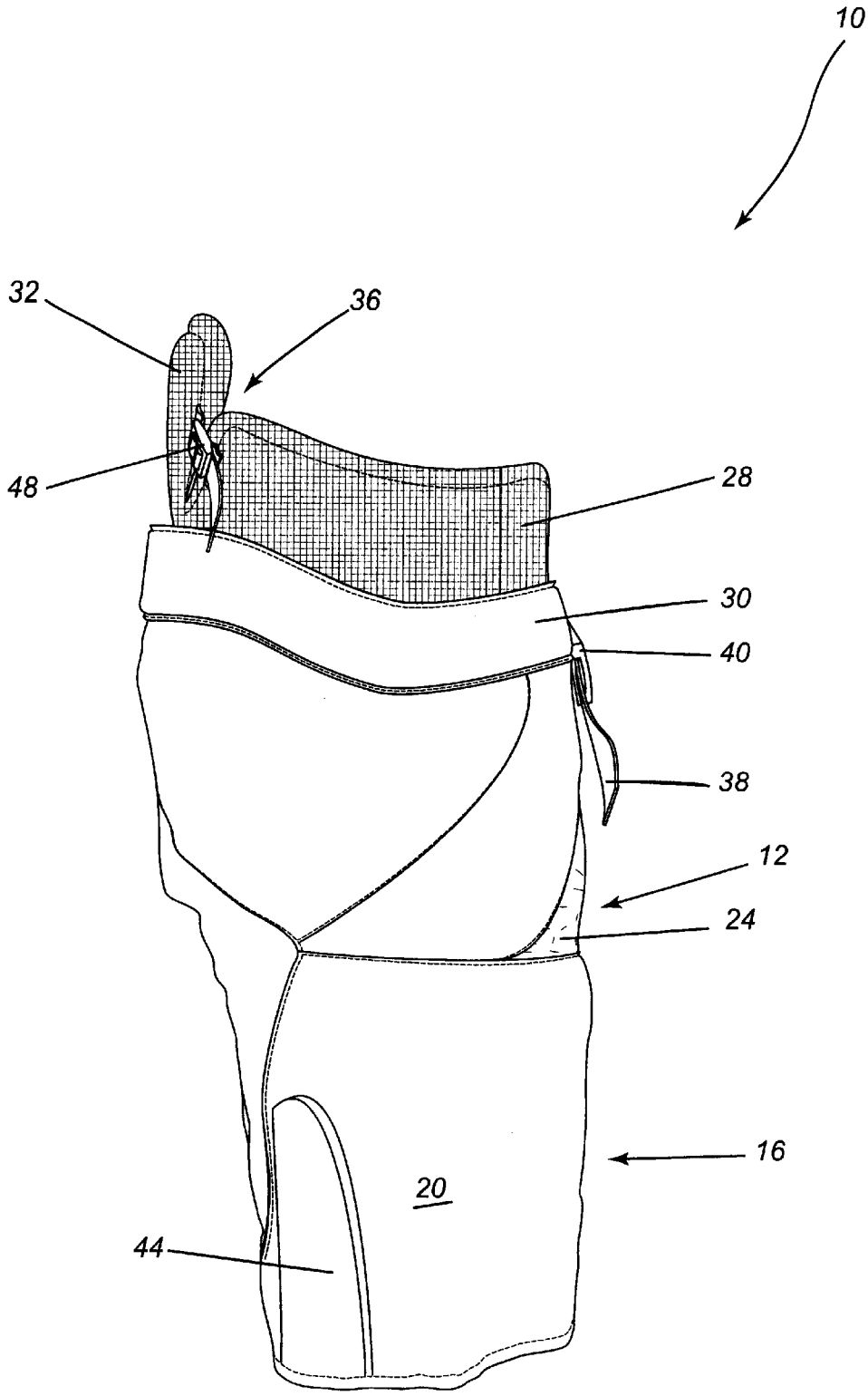
FIG. 6 is a right side elevational view of the hockey pants as depicted in FIG. 4.

FIGS. 4 to 6 illustrate the hockey pants 10 with floating belt 26 removed in order to more clearly show fixed belt 28. Fixed belt 28 comprises a dorsal protector 32 that is shaped like an inverted trapezoid so as to protect a greater area of the lower back region. Dorsal protector 32 is fabricated from multi-layered foam of varying densities or varying thickness' that function to dampen the impact of any blows in the lower back region. As shown in FIGS. 4 and 5, a pair of vertically extending seams 29, 31 delimits the various padding elements which compose dorsal protector 32. Seams 29, 31 enable dorsal protector 32 to better conform itself to the shape of the user's waist and also allow for greater mobility by reducing the rigidity of dorsal protector 32. The latter, along both of its sides, is separated from the remainder of fixed belt 28 by a set of V-notches 34, 36; the purpose of which will be detailed subsequently. More specifically, FIG. 5 illustrates that adjustment straps 35 and 37 extend across each respective V-notch 34, 36 and are linked, at one extremity, to dorsal protector 32 and, at the other extremity, to the side portions of fixed belt 28. Adjustment buckles 46 and 48 are also included and allow the adjustment of straps 35, 37. Although the Figures show that the means which permit the adjustment of dorsal protector 32 comprise straps and buckles, it should be expressly understood that alternative adjustment means could also be envisioned while nevertheless remaining within the scope of the invention. Such means, for example, could include but are not limited to straps with hooks and loops fasteners, snap buttons, belt-like fasteners, etc. FIG. 4 further illustrates that fixed belt adjustment means in the form of a waist-adjustment belt 38 and its corresponding attachment buckle 40 are also provided. As corroborated by the drawings, waist-adjustment belt 38 is dissimulated in the side and back regions by a sheath 30 that acts to prevent unnecessary vertical and lateral motion of waist-adjustment belt 38. Moreover, sheath 30 also prevents the formation of unnecessary holding means by which an opposing player may attempt to create interference. In order to modify the fit of hockey pants 10 to his or her girth, the user need only tighten waist-adjustment belt 38 and connect attachment buckle 40 to ensure a snug fit.

Figure 7:
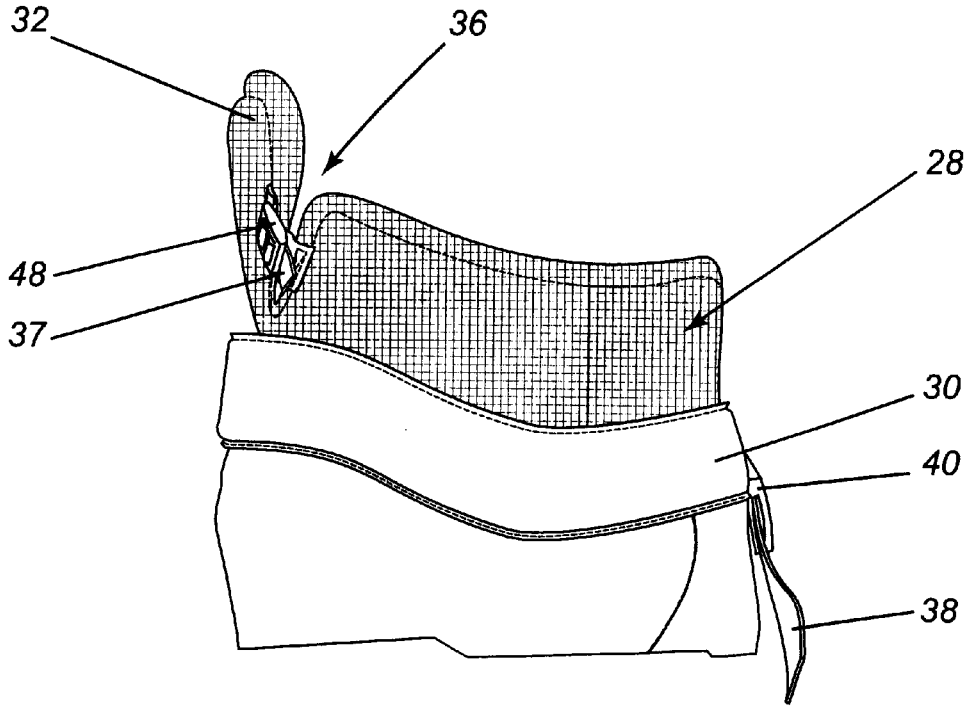
FIG. 7 is a side elevational view of the top portion of the hockey pants as depicted in FIG. 4, the dorsal adjustment straps being loosely tightened in order to show the dorsal protector in a reclined position.
Figure 8:
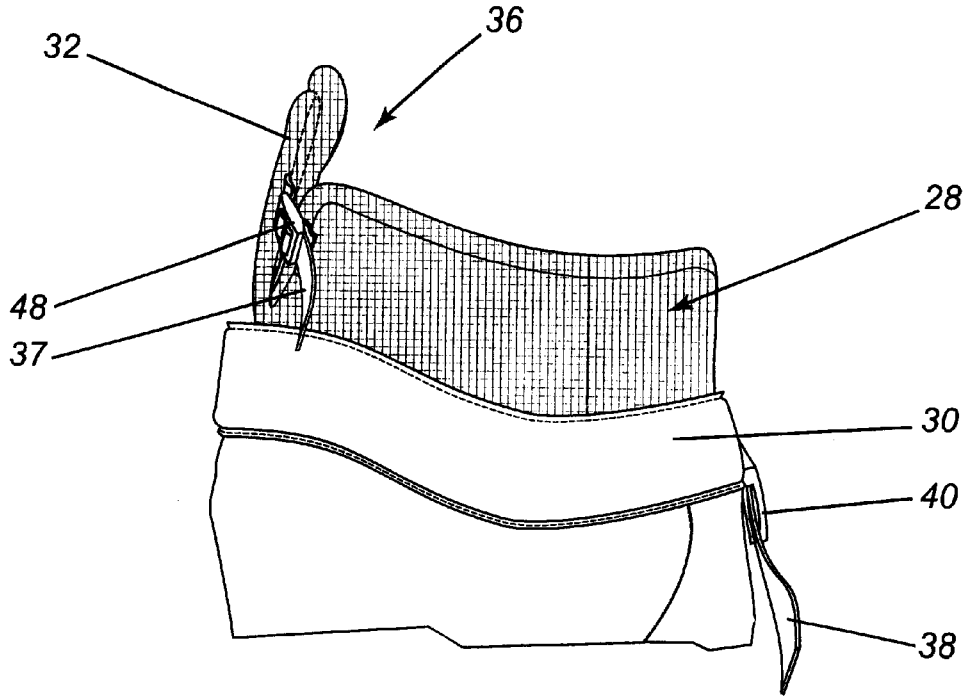
FIG. 8 is a side elevational view of the top portion of the hockey pants as depicted in FIG. 4, the dorsal adjustment straps being tightened in order to show the dorsal protector in an inclined position.

FIGS. 7 and 8 show dorsal protector 32 in reclined and inclined positions respectively. More specifically, FIG. 7 shows dorsal protector 32 when adjustment straps 35 and 37 are loosely tightened. The V-notches 34, 36 are therefore left gaping and, as a result, dorsal protector 32 adopts a more reclined position that does not conform to the wearer's lower back area. In order to adjust the inclination of dorsal protector 32 to suit his or her preferences or anatomy, the user need only tighten adjustment straps 35 and 37 via adjustment buckles 46 and 48 respectively. This action causes the dorsal protector 32 to tilt forward by closing V-notches 34 and 36, thereby bringing together both sides of dorsal protector 32 with the remainder of fixed belt 28. When dorsal protector 32 is inclined as such, it closely conforms to the anatomy of the wearer's lower back region thereby providing additional support and cushioning to this area. Moreover, as stated previously, a hockey player will adopt numerous stances and positions during the course of a game or practice. Thus, dorsal protector 32, by closely following the lower back of the wearer when adjustment straps 35, 37 have been tightened, is able to closely follow the lower back of the wearer in all stances. It should be noted that dorsal protector 32 need only be adjusted once, immediately subsequent to the acquirement of the hockey pants 10, and can thereafter be maintained at the user's preferred adjustment position.

Figure 9:
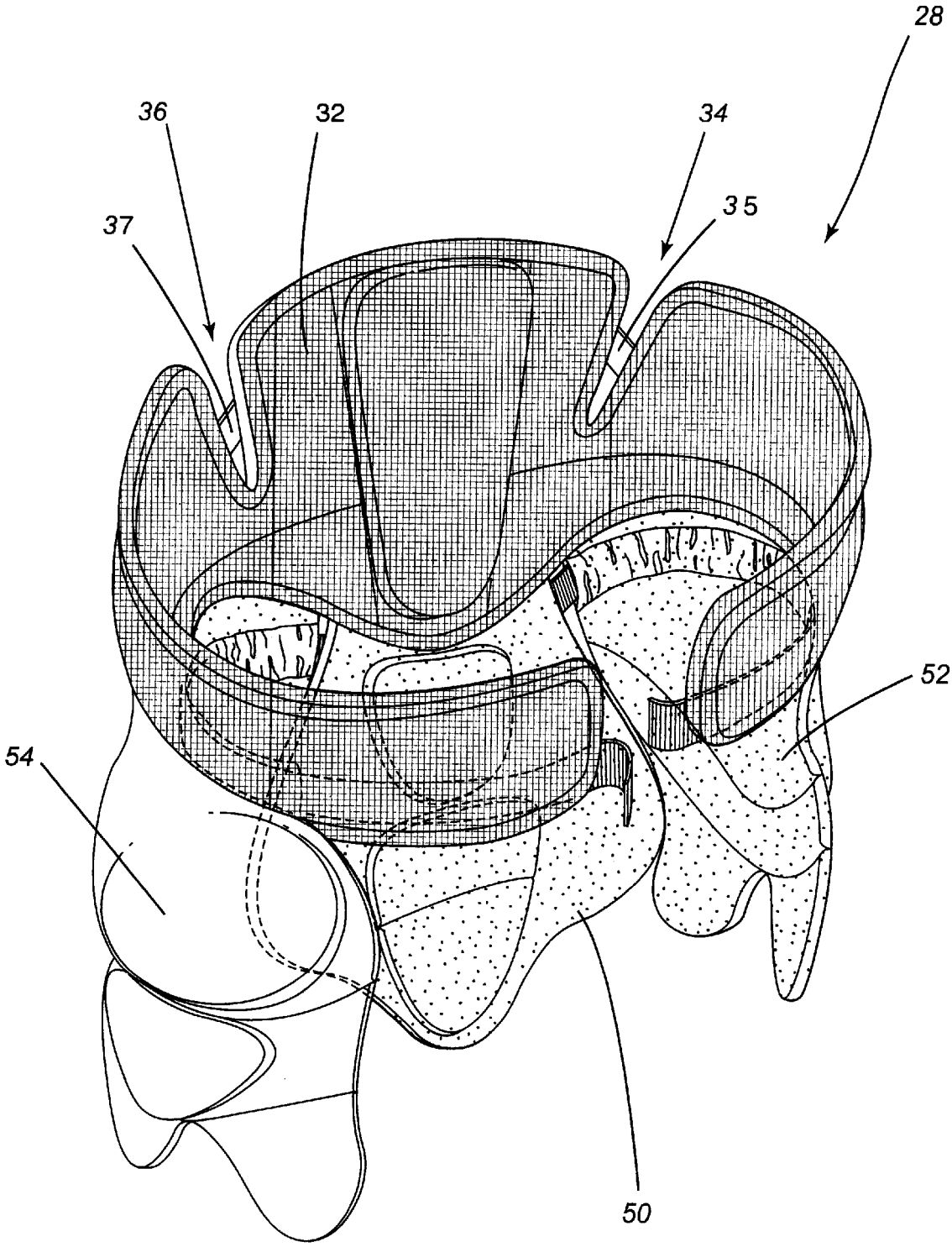
FIG. 9 is a front perspective view of the fixed belt when removed from the hockey pants depicted in FIG. 1.

FIG. 9 shows fixed belt 28 when the latter is isolated from hockey pants 10. As shown, dorsal protector 32 protects the lower spine region of the wearer. Moreover, a supple gluteus padding element 50 is fixedly attached to the lower portion of dorsal protector 32. Gluteus padding element 50 provides the dual function of cushioning any blows to the tailbone area as well as augmenting the comfort level by creating a barrier between main body 11 and the user. Thus, should the user fall on his or her hind portion during the course of a game or practice, additional protection is provided. FIG. 9 further shows that hip padding elements 52, 54 are fixedly connected to the left and right sides of fixed belt 28. Left and right hip padding elements 52, 54 are shaped in such a manner as to overlie the wearer's left and right hipbones, the latter regions being particularly susceptible to painful blows in contact sports such as hockey.

In order to don the hockey pants 10, the player need only insert his or her legs into the corresponding left and right thigh portions 14, 16 and pull up the pants. Once the hockey pants 10 are at their desired position, the user can then, if necessary, adjust dorsal protector 32 according to his or her preferences. The coupling of floating belt 26 to fixed belt 28 (i.e., elastic bonds) easily permits the user to grasp each adjustment buckle 46, 48 and tighten or loosen adjustment straps 35 and 37 accordingly. The player can then modify the hockey pants 10 to his or her girth via waist adjustment belt 38 and secure it by snapping buckle 40 shut. Although the majority of the Figures have shown the hockey pants 10 as comprising a floating belt 26, it should be expressly understood that the presence of such a floating belt is not essential and its absence does not detract from the spirit of the invention.

The above description of preferred embodiments should not be interpreted in a limiting manner since other variations, modifications and refinements are possible within the spirit and scope of the present invention. The scope of the invention is defined by the appended claims and their equivalents.

What is claimed is:

1. Hockey pants for playing hockey and similar sporting activities, said hockey pants comprising:

a main body including:

a) a pelvic area portion encircling the pelvic area of the wearer's body;

b) a right thigh area portion depending from said pelvic area portion for covering the right thigh area of the wearer's body;

c) a left thigh area portion depending from said pelvic area portion for covering the left thigh area of the wearer's body;

a fixed belt integrally connected to said main body, said fixed belt including:

a) a plurality of selectively positioned padding elements operative to protect the user's midsection, said selectively positioned padding elements including an adjustable dorsal protector adapted to extend over and protect the lower spine region of the wearer;

b) an adjusting component operative to modify the positioning of said dorsal protector relative to the back of the wearer's body;

a floating belt flexibly connected to said main body, said floating belt overlying said fixed belt and allowing access to said adjusting component.

2. Hockey pants as defined in claim 1, wherein said adjusting component comprises a set of adjustment straps and buckles.

3. Hockey pants as defined in claim 2, wherein each said adjustment strap extends from one side of said dorsal protector to an adjacent portion of said fixed belt.

4. Hockey pants as defined in claim 1, wherein said dorsal protector is of trapezoidal shape.

5. Hockey pants as defined in any one of claim 1, wherein said dorsal protector comprises seams that increase the flexibility of said dorsal protector.

6. Hockey pants as defined in claim 5, wherein said seams extend in a substantially vertical direction.

7. Hockey pants as defined in claim 1, wherein said fixed belt comprises a waist-adjustment component being operative to modify the fit of said hockey pants to accommodate user's of varying girths.

8. Hockey pants as defined in claim 7, wherein said waist-adjustment component includes a belt and a fastening buckle.

9. Hockey pants as defined in claim 8, wherein said belt is partially dissimulated in a sheath extending along the circumference of said hockey pants.

10. Hockey pants as defined in claim 1, wherein said floating belt is connected to said main body by elastic straps.

11. Hockey pants as defined in claim 1, wherein said main body comprises a plurality of selectively positioned portions made of fabric exhibiting elastic properties, said selectively positioned portions allowing for greater mobility.

12. Hockey pants as defined in claim 1, wherein said dorsal protector is made of multi-layered foam.

13. Hockey pants as defined in claim 1, wherein said fixed belt includes a gluteus padding element operative to protect the hind portion of the wearer.

14. Hockey pants for playing hockey and similar sporting activities, said hockey pants comprising:

a) a main body including:

a) a pelvic area portion encircling the pelvic area of the wearer's body;

b) a right thigh area portion depending from said pelvic area portion for covering the right thigh area of the wearer's body;

c) a left thigh area portion depending from said pelvic area portion for covering the left thigh area of the wearer's body;

a fixed belt integrally connected to said main body, said fixed belt including:

a) a plurality of selectively positioned padding elements operative to protect the user's midsection, said selectively positioned padding elements including an adjustable dorsal protector adapted to extend over and protect the lower spine region of the wearer; and b) an adjusting component operative to modify the positioning of said dorsal protector relative to the back of the wearer's body.

15. Hockey pants as defined in claim 14, wherein said adjusting component comprises a set of adjustment straps and buckles.

16. Hockey pants as defined in claim 15, wherein each said adjustment strap extends from one side of said dorsal protector to an adjacent portion of said fixed belt.

17. Hockey pants as defined in claim 16, wherein said dorsal protector is of trapezoidal shape.

18. Hockey pants as defined in claim 17, wherein said dorsal protector is made of multi-layered foam.

19. Hockey pants as defined in claim 18, wherein said dorsal protector comprises seams that increase the flexibility of said dorsal protector.

20. Hockey pants as defined in claim 19, wherein said seams extend in a substantially vertical direction.

21. Hockey pants as defined in claim 14, wherein said fixed belt comprises a waist-adjustment component being operative to modify the fit of said hockey pants to accommodate user's of varying girths.

22. Hockey pants as defined in claim 21, wherein said waist-adjustment component includes a belt and a fastening buckle.

23. Hockey pants as defined in claim 22, wherein said belt is partially dissimulated in a sheath extending along the circumference of said hockey pants.

24. Hockey pants as defined in claim 14, wherein said main body comprises a plurality of selectively positioned portions made of fabric exhibiting elastic properties, said selectively positioned portions allowing for greater mobility.

25. Hockey pants as defined in claim 14, further comprising a floating belt flexibly connected to said main body, said floating belt overlying said fixed belt and allowing access to said adjusting component.

26. Hockey pants as defined in claim 14, wherein said fixed belt includes a gluteus padding element operative to protect the hind portion of the wearer.

27. A hockey pants for a body of a wearer having a pelvic area, right and left thigh areas, a lower spine region and a lower kidney area, said hockey pants comprising:

(a) a main body comprising a pelvic area portion encircling the pelvic area and right and left thigh area portions depending from said pelvic area portion for covering the right and left thigh areas respectively; and (b) a belt on said main body, said belt comprising a plurality of padding elements for covering the lower kidney area, said padding elements comprising an adjustable dorsal protector facing the lower spine region, said belt further comprising means for adjusting said adjustable dorsal protector from a reclined position to an inclined position wherein, in said inclined position, said adjustable dorsal protector follows the lower spine region.

28. The hockey pants as defined in claim 27, wherein said means comprise a set of adjustment straps and buckles.

29. The hockey pants as defined in claim 28, wherein each said adjustment strap extends from one side of adjustable dorsal protector to an adjacent portion of said belt.

* * * * *

UNITED STATES PATENT AND TRADEMARK OFFICE

CERTIFICATE OF CORRECTION

PATENT NO. : 6,637,036 B2
DATED : October 28, 2003
INVENTOR(S) : Jean-François Béland It is certified that error appears in the above-identified patent and that said Letters Patent is hereby corrected as shown below:

Title page,
Insert Item:
-- [30] Foreign Application Priority Data
November 10, 2000, (CA), 2,325,681 --

Signed and Sealed this

Second Day of March, 2004

JON W. DUDAS
*Acting Director of the United States Patent and Trademark Office*